US011225734B1

(12) United States Patent
Solano

(10) Patent No.: US 11,225,734 B1
(45) Date of Patent: Jan. 18, 2022

(54) TOWEL ASSEMBLY

(71) Applicant: Victor Solano, Bronx, NY (US)

(72) Inventor: Victor Solano, Bronx, NY (US)

( * ) Notice: Subject to any disclaimer, the term of this patent is extended or adjusted under 35 U.S.C. 154(b) by 0 days.

(21) Appl. No.: 17/323,326

(22) Filed: May 18, 2021

(51) Int. Cl.
*D03D 27/08* (2006.01)
*A47K 10/02* (2006.01)

(52) U.S. Cl.
CPC ..... *D03D 27/08* (2013.01); *A47K 10/02* (2013.01); *D10B 2201/02* (2013.01); *D10B 2211/04* (2013.01); *D10B 2331/04* (2013.01)

(58) Field of Classification Search
CPC .... D03D 27/08; A47K 10/02; D10B 2331/04; D10B 2201/02; D10B 2211/04
See application file for complete search history.

(56) References Cited

U.S. PATENT DOCUMENTS 4,571,960 A * 2/1986 Hursh ..... D04B 1/26 66/196
4,843,844 A * 7/1989 Hursh ..... D04B 1/02 66/196
5,675,992 A * 10/1997 Wrightenberry ..... A41B 11/005 2/239
6,108,820 A * 8/2000 Bernhardt ..... A41B 11/005 2/239
7,281,549 B2 * 10/2007 Metzger ..... D03D 11/00 139/407
7,399,286 B2 * 7/2008 Jackson ..... A01K 13/00 442/238
7,861,358 B2 * 1/2011 Moser ..... A47L 13/16 15/118
8,646,459 B2 * 2/2014 Carlson ..... A41D 31/185 128/889
8,919,347 B2 * 12/2014 Carlson ..... A61G 5/1043 128/889
9,241,853 B2 * 1/2016 Carlson ..... A61G 7/057
9,365,960 B2 * 6/2016 Craig ..... A41B 11/005
10,624,395 B2 * 4/2020 Craig ..... D04B 1/26
2002/0118993 A1 * 8/2002 Lafosse-Marin ..... A47L 13/19 401/201
2006/0037555 A1 * 2/2006 Jackson ..... A01K 13/00 119/601
2008/0263799 A1 * 10/2008 Moser ..... A47L 23/10 15/118
2012/0124740 A1 * 5/2012 Castle ..... A47D 15/003 5/420
2016/0242480 A1 * 8/2016 Mata ..... B32B 5/06
2017/0198432 A1 * 7/2017 Richards ..... D06N 3/009

* cited by examiner

*Primary Examiner* — Robert H Muromoto, Jr.
(74) *Attorney, Agent, or Firm* — Andrew S. Rapacke

(57) ABSTRACT

A towel assembly is including a plurality of layers including a first layer and a fourth layer constructed of a textile terry cloth. A second layer and a third layer are constructed of a fabric, each of the first layer, the second layer, the third layer, and the fourth layer are retained to one another such that the first layer and the fourth layer are arranged to interact with a surface. The second layer and the third layer are retained between the first layer and the fourth layer. The towel assembly is arranged to reduce friction when interacting with the surface.

20 Claims, 3 Drawing Sheets

TOWEL ASSEMBLY

CROSS-REFERENCE TO RELATED APPLICATIONS

The present application claims priority to U.S. Provisional Application No. 62/765,476 filed on Aug. 27, 2018, entitled "Invigor Towel" the entire disclosure of which is incorporated by reference herein.

TECHNICAL FIELD

The embodiments generally relate to textiles and more particularly to therapeutic frictionless cloths.

BACKGROUND

There are many applications for absorbent cloths are utilized. For example, cloths may be used for cooling hot (and possibly sweaty) skin following an activity such as playing sports, exercising, or bathing. Towels and similar cloths may also be used for therapeutic purposes, such as to improve circulation and promote hair growth, relax muscles in a desired area, and open pores along the skin.

It is known that the continued use of common towels may cause significant damage to the epidermis, which may lead to various long-term health concerns. Damage to the epidermis may be caused by friction between the towel and skin during periods of continued use. An example of such use is the rubbing of a towel against the skin in an attempt to improve circulation. Towels may be especially uncomfortable if the user is sunburned, has an existing skin condition, or is recovering from an injury to the epidermis.

SUMMARY OF THE INVENTION

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

The embodiments provided herein relate to a towel assembly, comprising a plurality of layers including a first layer and a fourth layer, each constructed of a textile terry cloth. The second and third layers are constructed of a fabric, each of the first layer, the second layer, the third layer, and the fourth layer are attached to each another such that the first layer and the fourth layer are configured to interact with a surface. The second layer and the third layer are retained between the first layer and the fourth layer. The first and fourth layers comprise the outermost layers of the towel, with the second and third layers in between. The towel assembly is arranged to reduce friction when interacting with the surface.

The towel assembly may be used in various applications that benefit from the interaction with a towel having properties which reduce the friction imparted on the surface. In one aspect, the towel assembly is utilized by a user to increase blood flow without damaging the skin of the user. In another aspect, the towel assembly is beneficial for washing a vehicle to reduce damage to the vehicle's sensitive surfaces. The towel assembly is also beneficial for reducing hair loss and even promoting hair loss in regions in which the towel is applied In one aspect, the terry cloth comprises organic cotton, polyester, or a blend.

In one aspect, the second layer and the third layer are each provided as a satin weave.

In one aspect, the fabric is silk or a polyester.

In one aspect, the second layer is arranged to have a vertical fabric direction such that the wrong side of the fabric contacts the backside of the first layer. Further, the third layer is arranged to have a horizontal fabric direction such that the right side of the fabric contacts the backside of the second layer.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 2:
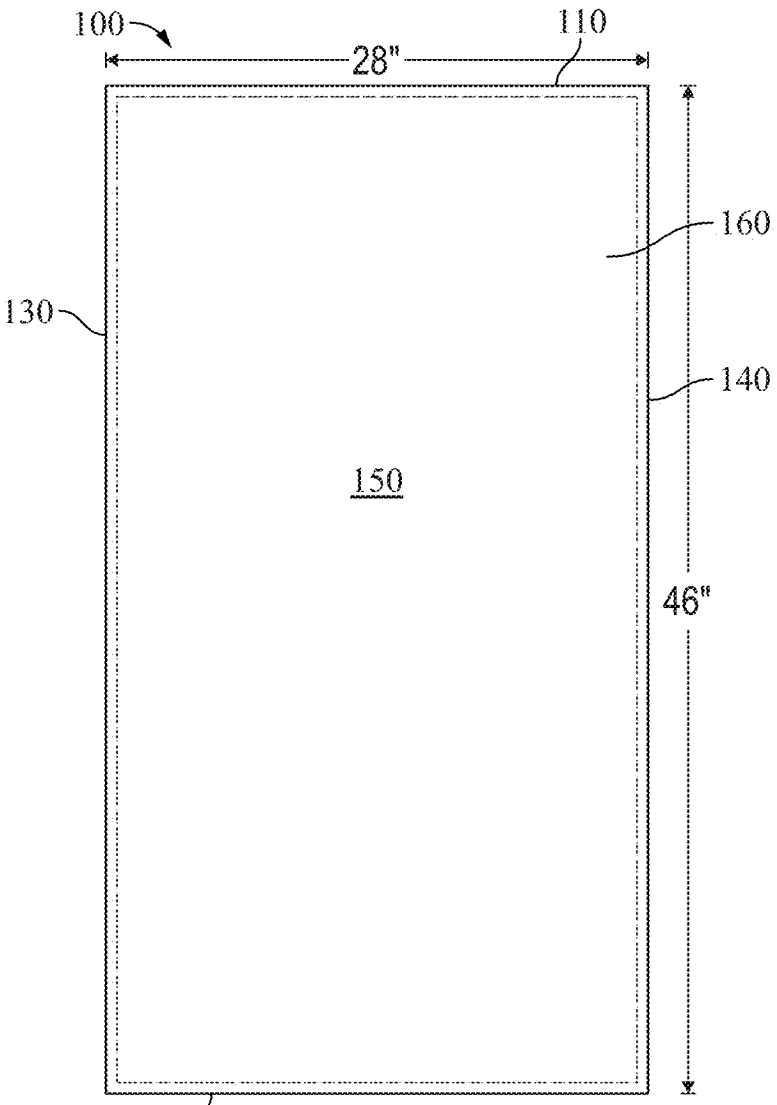
FIG. 2 illustrates a front elevation view of the therapeutic towel, according to some embodiments.

The specific details of the single embodiment or variety of embodiments described herein are to the described device and methods of use. Any specific details of the embodiments are used for demonstration purposes only, and no unnecessary limitations or inferences are to be understood from there.

Before describing in detail exemplary embodiments, it is noted that the embodiments reside primarily in combinations of components of the device and its use. Accordingly, the components of the device have been represented, where appropriate, by conventional symbols in the drawings, showing only the specific details necessary for the understanding of the embodiments of the present disclosure, so as not to obscure the disclosure with details that will be readily apparent to those of ordinary skill in the art having the benefit of the description herein.

In general, the embodiments provided herein relate to a towel assembly having a plurality of layers which promote blood flow when properly applied to the skin. Each layer of the towel is arranged to reduce the friction imparted between the surface of the towel and the surface of the skin to reduce damage to the skin (which may also be referred to herein as the epidermis.

The towel assembly may also be utilized to reduce hair follicle damage, which may reduce the rate of hair loss and promote the regrowth of hair where the towel is applied. Further, the towel assembly may be utilized for washing cars, windows, or other objects having surfaces which may be degraded by excessive and/or prolonged abrasion.

Figure 1:
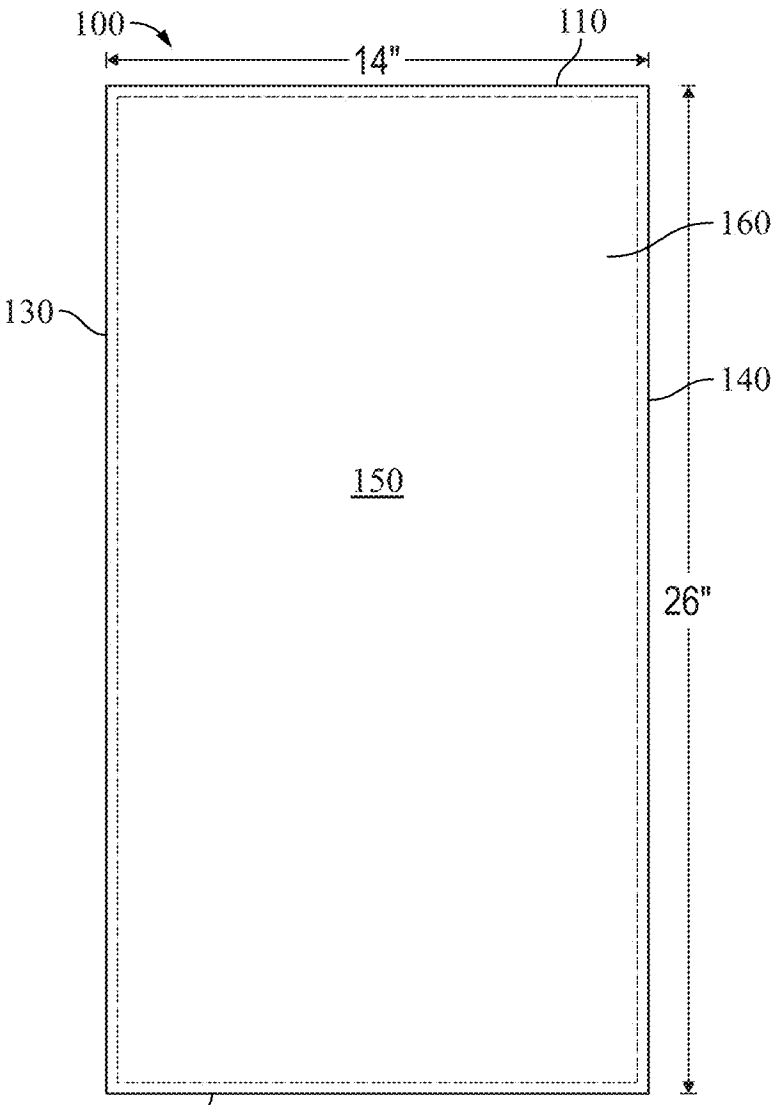
FIG. 1 illustrates a front elevation view of the therapeutic towel, according to some embodiments.

FIG. 1 and FIG. 2 illustrate an exemplary embodiment of the towel assembly 100 in an exemplary embodiment. It should be understood that the dimensions provided are exemplary and should not be limited to any particular size, shape, or configuration. The towel is comprised of a top edge 110, bottom edge 120, left edge 130, and right edge 140. The surface 150 of the front side 160 and the backside (not shown) contacts the user's skin and provides a substantially frictionless surface to reduce the damage to the skin and reduce the abrasiveness of the surface texture.

Figure 3:
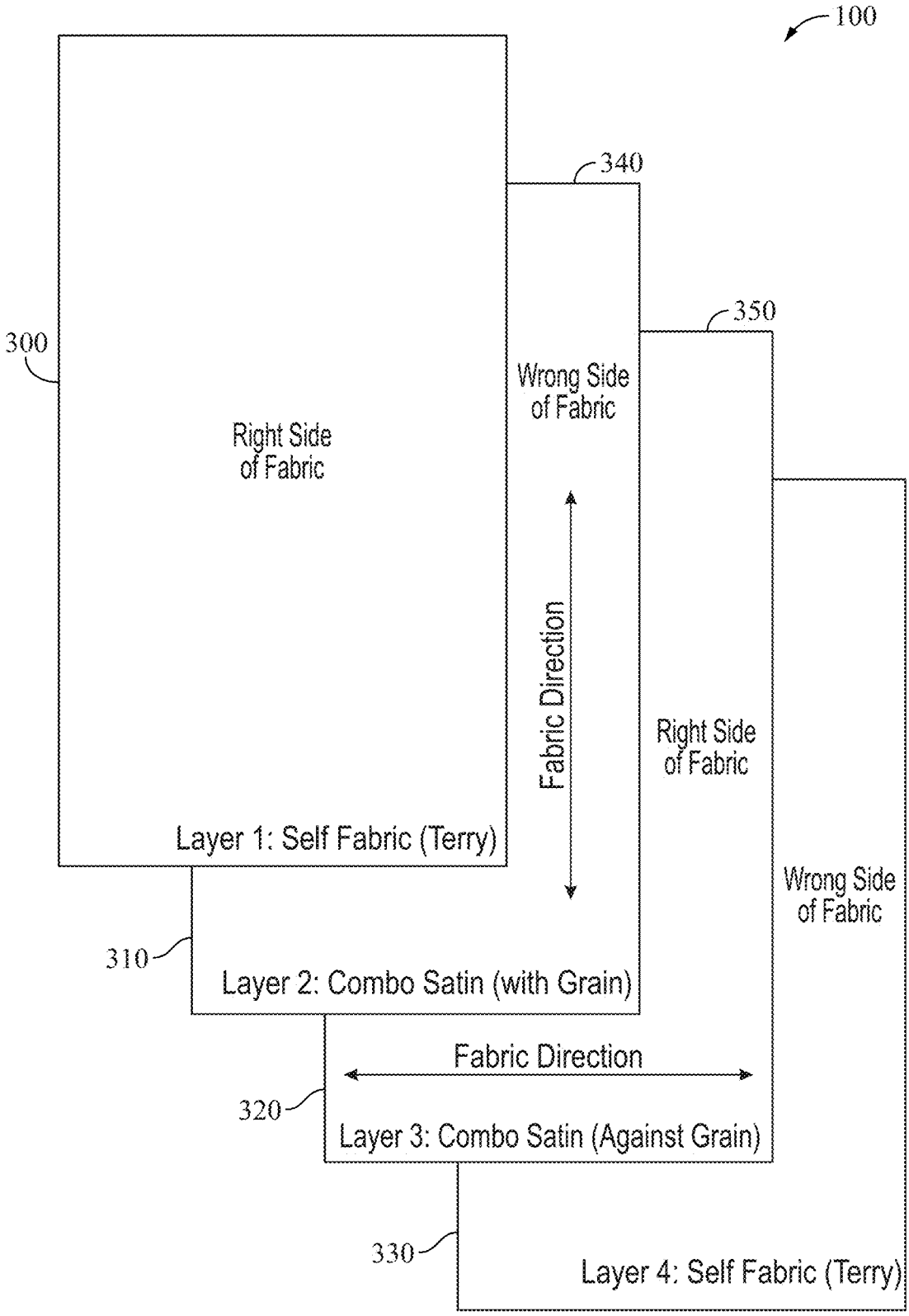
FIG. 3 illustrates an exploded view of the therapeutic towel, according to some embodiments.

FIG. 3 illustrates an exploded view of the towel assembly 100 comprising a first layer 300, a second layer 310, a third layer 320, and a fourth layer 330. The front side 160 of the first layer 300 and the surface fourth layer 330 are arranged to contact the skin of the user and provide a substantially frictionless surface to reduce damage to the skin. The first layer 300 and fourth layer 330 are constructed of terry cloth. The second layer 310 and the third layer 320 are comprised of a textile having a satin weave. The second layer 310 is arranged having a vertical fabric direction $d_1$ such that the "wrong side" 340 of the fabric contacts the backside (not shown) of the first layer 300. The third layer 320 is arranged having a horizontal fabric direction $d_2$ such that the "right side" 350 of the fabric contacts the backside (not shown) of the second layer 310. The arrangement of each layer reduces the friction imparted to the skin of the user.

Figure 5:
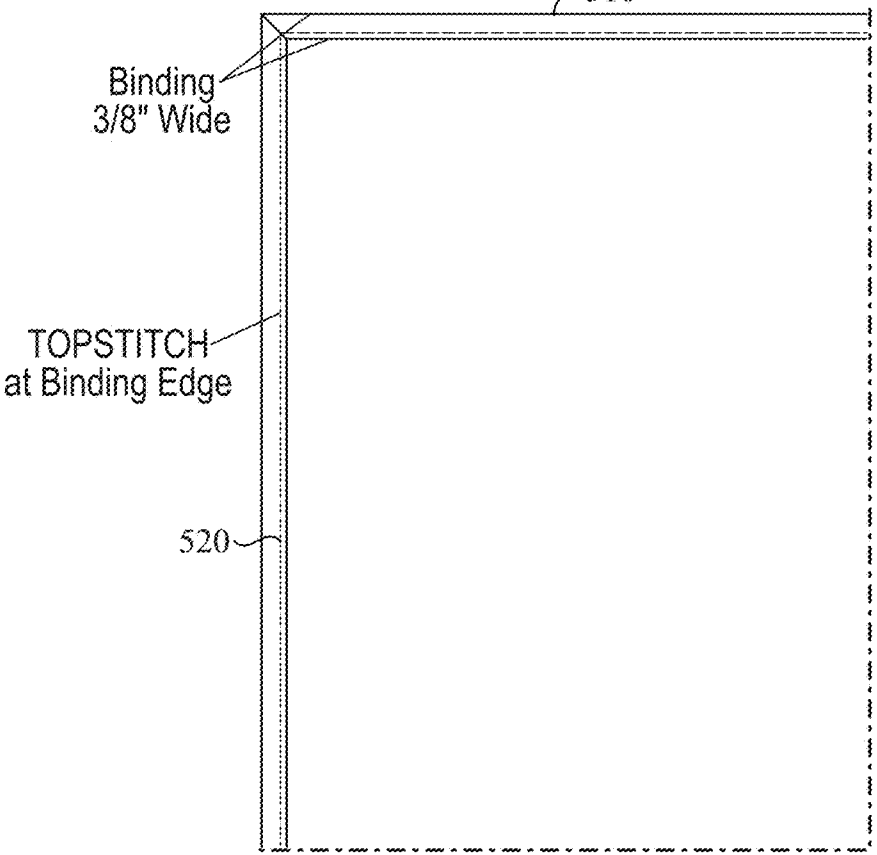
FIG. 5 illustrates a detail view of the therapeutic towel comprising a binding edge, according to some embodiments.
Figure 4:
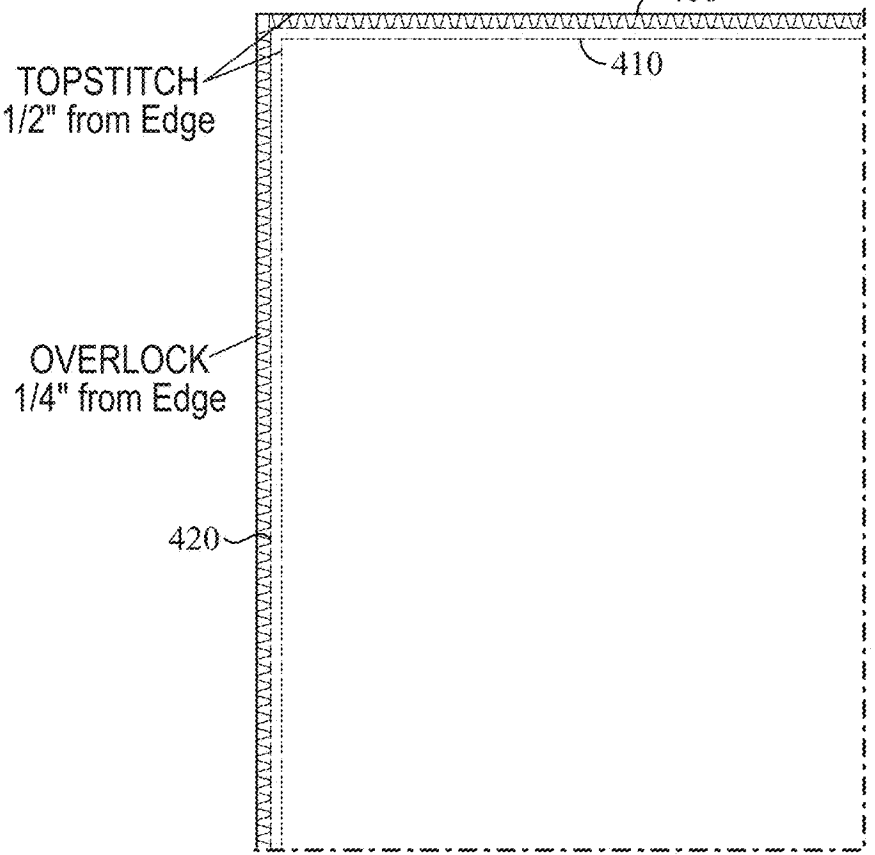
FIG. 4 illustrates a detail view of the therapeutic towel comprised of a topstitch and overlock edge, according to some embodiments.

FIG. 4 illustrates a detailed view of the edges having one or more top stitches 400, 410 and an overlock 420 as a secondary attachment means which retain each of the four layers together into a single towel assembly. FIG. 5 illustrates an alternative embodiment wherein a binding 500 and a binding topstitch 510 as a secondary attachment means which is utilized to retain each of the four layers together into a single towel assembly. One skilled in the arts will readily understand that various other textile connection techniques known in the arts may be utilized.

In some embodiments, the terry cloth may be manufactured by weaving or knitting. The terry cloth provides an absorbent surface for absorbing liquids on the skin of the user, or on another surface whereon the towel is applied. The terry cloth may be one-hundred percent cotton or may be a blend with other known textiles such as polyester and spandex.

In some embodiments, the textile is silk or polyester. One skilled in the arts will understand that various textiles may be used inclusive of textile blends.

In some embodiments, the towel assembly may be constructed as a bathrobe, bed linen, sweatband, or another item commonly constructed of a textile that may benefit from having a surface of reduced abrasiveness, specifically when in connection with another surface. For example, the towel assembly may be utilized for washing an automobile to protect the appearance of the paint, clear coat, or window tint surfaces, all of which may be easily scratched or degraded during washing by common textiles.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below, or that a single element can be substituted for two or more elements in a claim. Although elements can be described above as acting in certain combinations and even initially claimed as such, it is to be expressly understood that one or more elements from a claimed combination can, in some cases, be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A towel assembly, comprising:

a plurality of layers including a first layer and a fourth layer each constructed of a textile terry cloth, a second layer and a third layer constructed of a fabric, each of the first layer, the second layer, the third layer, and the fourth layer are retained to one another such that the first layer and the fourth layer are arranged to interact with a surface, the second layer and the third layer are retained between the first layer and the fourth layer, the towel assembly arranged to reduce friction when interacting with the surface, wherein each layer, has on each surface a weaving pattern grain direction; and a grain direction of the third layer grain that contacts the backside of the second layer is offset to the grain direction of the backside of the second layer.

2. The towel assembly of claim 1, wherein the terry cloth comprises organic cotton.

3. The towel assembly of claim 1, wherein the terry cloth comprises polyester.

4. The towel assembly of claim 1, wherein the terry cloth comprises organic cotton and a polyester blend.

5. The towel assembly of claim 1, wherein the second layer and the third layer are each provided as a satin weave.

6. The towel assembly of claim 5, wherein the fabric is silk.

7. The towel assembly of claim 5, wherein the fabric is polyester.

8. A towel assembly, comprising:

a plurality of layers including a first layer and a fourth layer each constructed of a textile terry cloth, a second layer and a third layer constructed of a fabric, each of the first layer, the second layer, the third layer, and the fourth layer are retained to one another such that the first layer and the fourth layer are arranged to interact with a surface to reduce friction imparted to the surface, the second layer and the third layer are retained between the first layer and the fourth layer, the second layer arranged having the wrong side of the fabric contacting the backside of the first layer, and wherein each layer, has on each surface a weaving pattern grain direction; and a grain direction of the third layer grain that contacts the backside of the second layer is offset to the grain direction of the backside of the second layer.

9. The towel assembly of claim 8, wherein the wrong side of the second layer has a vertical fabric direction with the grain.

10. The towel assembly of claim 8, wherein the right side of the third layer has a horizontal fabric direction.

11. The towel assembly of claim 8, wherein the terry cloth comprises organic cotton.

12. The towel assembly of claim 8, wherein the terry cloth comprises polyester.

13. The towel assembly of claim 8, wherein the terry cloth comprises an organic cotton and a polyester blend.

14. The towel assembly of claim 8, wherein the second layer and the third layer are each provided as a satin weave.

15. The towel assembly of claim 14, wherein the fabric is silk.

16. The towel assembly of claim 14, wherein the fabric is polyester.

17. A towel assembly, comprising:

a plurality of layers including a first layer and a fourth layer each constructed of a textile terry cloth, a second layer and a third layer constructed of a fabric;

one or more topstitches and one or more secondary attachment means to retain each of the first layer, the second layer, the third layer, and the fourth layer to one another such that the first layer and the fourth layer are arranged to interact with a surface to reduce friction imparted to the surface, the second layer and the third layer are retained between the first layer and the fourth layer, the second layer arranged having the wrong side of the fabric contacting the backside of the first layer, and wherein each layer, has on each surface a weaving pattern grain direction; and a grain direction of the third layer grain that contacts the backside of the second layer is offset to the grain direction of the backside of the second layer.

18. The towel assembly of claim 17, wherein the one or more secondary attachment means is an overlock.

19. The towel assembly of claim 17, wherein the one or more secondary attachment means is a binding.

20. The towel assembly of claim 17, wherein the towel assembly is constructed as a bed linen.

* * * * *